US008604997B1

(12) United States Patent
Cencich, Sr. et al.

(10) Patent No.: US 8,604,997 B1
(45) Date of Patent: Dec. 10, 2013

(54) VERTICAL ARRAY ANTENNA

(75) Inventors: Thomas P. Cencich, Sr., Littleton, CO (US); W. Neill Kefauver, Littleton, CO (US); Jeannette C McDonnell, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 705 days.

(21) Appl. No.: 12/792,646

(22) Filed: Jun. 2, 2010

(51) Int. Cl.
*H01Q 21/06* (2006.01)

(52) U.S. Cl.
USPC ..... 343/844; 343/700 MS; 343/890

(58) Field of Classification Search
USPC ..... 343/741, 742, 844, 853, 867, 700 MS, 343/890
See application file for complete search history.

(56) References Cited

U.S. PATENT DOCUMENTS

| | | | | |
|---|---|---|---|---|
| 2,682,050 | A | 6/1954 | Alford | |
| 3,626,418 | A | 12/1971 | Berryman | |
| 4,223,315 | A | 9/1980 | Alford | |
| 4,479,127 | A * | 10/1984 | Barbano | 343/742 |
| 4,547,776 | A | 10/1985 | Bolt, Jr. et al. | |
| 5,243,354 | A * | 9/1993 | Stern et al. | 343/700 MS |
| 5,274,391 | A * | 12/1993 | Connolly | 343/820 |
| 5,757,324 | A * | 5/1998 | Helms et al. | 343/700 MS |
| 5,767,809 | A | 6/1998 | Chuang et al. | |
| 6,222,503 | B1 * | 4/2001 | Gietema et al. | 343/890 |
| 7,098,861 | B2 | 8/2006 | Theobold et al. | |
| 7,196,674 | B2 * | 3/2007 | Timofeev et al. | 343/810 |
| 2007/0069968 | A1 | 3/2007 | Moller et al. | |
| 2008/0062062 | A1 * | 3/2008 | Borau et al. | 343/844 |
| 2013/0069813 | A1 * | 3/2013 | Vangen et al. | 342/1 |

OTHER PUBLICATIONS

Caswell, "Analysis of a Helix Antenna Using a Moment Method Approach With Curved Basis and Testing Functions", M.S. Thesis, Virginia Polytechnic Institute and State University, 1998 (Abstract).
Mandl et al., "Optimizing Satellite Communications With Adaptive and Phased Array Antennas", NASA Ground System Architectures Workshop, 2004.

* cited by examiner

*Primary Examiner* — Tho G Phan
(74) *Attorney, Agent, or Firm* — McDermott Will & Emery LLP

(57) ABSTRACT

A vertical array antenna is disclosed. The antenna includes a housing configured to be positioned above a ground plane and a plurality of antenna elements. Each antenna element produces an individual beam pattern. The antenna elements are attached to the housing at different distances from the location of the ground plane such that the amplitudes of the individual beam patterns of the respective antenna elements have local maxima at a common angle and frequency when the housing is positioned above the ground plane.

18 Claims, 10 Drawing Sheets

VERTICAL ARRAY ANTENNA

STATEMENT REGARDING FEDERALLY SPONSORED RESEARCH OR DEVELOPMENT

Not applicable.

BACKGROUND

1. Field

The present disclosure generally relates to antennas and, in particular, to vertical array antennas having a ground plane.

2. Description of the Related Art

Maintaining a communication link between a satellite in low-Earth orbit (LEO) and a communication station on the ground is a challenge as the satellite flies by at roughly 17,000 miles per hour. The satellite's communication antenna must be able to either steer the communication beam or have a very broad beam pattern. Some satellites, such as the Hubble Space Telescope, incorporate a physically steerable parabolic dish that can track the ground station. Another type of steerable antenna, referred to as a "phased array", uses multiple fixed antennas and adjusts the timing of the signals from each antenna to steer the beam. Some satellites frequently use a single fixed antenna designed to provide a broad beam. As the majority of the Earth's surface visible from a LEO satellite is at a significant angle to the nadir axis, it is desirable for the satellite antenna to have good coverage at angles of 30-80 degrees from the nadir axis. A null spot in the beam pattern directly on the nadir axis is sometimes acceptable as the amount of ground coverage lost is a very small part of the total contact area.

Antenna size and complexity are also important factors in satellite design. Particularly for small satellites, there may be height or width limits on the size of the antenna to avoid interference with adjacent antennas or to fit inside the launch vehicle fairing. The number of elements of an antenna also drives cost and weight both directly and indirectly, as larger numbers of elements require larger and stronger supporting structure. Minimizing the volume and complexity of an antenna, and thus the number and the size of the elements, is desirable.

Designing an antenna with multiple elements enables the designer to shape the beam and achieve a higher gain than possible with a single radiative element. One design approach is to stack multiple antenna elements in a vertical array. The spacing between elements is limited on the low end by mutual coupling effects, and is limited on the high end by the creation of interfering secondary lobes as the spacing approaches one wavelength. A "rule of thumb" that balances these factors is to use a half-wavelength for the inter-element spacing in vertical arrays.

SUMMARY

This disclosure describes an antenna that provides a broad beam pattern suitable for a satellite in low-earth orbit, presumed to be one or more axis stabilized. This antenna uses multiple antenna elements in a fixed vertical array over a ground plane. The array is located on an axis perpendicular to the ground plane, which is parallel to the earth, and is designed to produce an antenna beam that is at an angle to this axis and symmetric about the axis. The locations of the antenna elements are selected to align the fields of the multiple antenna elements as well as use the reflections of back lobes from the ground plane to add to the beam pattern in the far field. In the example 3 GHz system described herein, the antenna designed in accordance with certain embodiments of this disclosure is approximately half the height and uses approximately 70% fewer elements compared to a standard antenna having the same gain and beam angle.

According to certain embodiments, a vertical array antenna is disclosed. The vertical array antenna includes a housing configured to be positioned above a ground plane and a plurality of antenna elements. Each antenna element produces an individual beam pattern. The antenna elements are attached to the housing at different distances from the location of the ground plane such that amplitudes of the individual beam patterns of the respective antenna elements have local maxima at a common angle and frequency when the housing is positioned above the ground plane.

According to certain embodiments, an antenna system is disclosed. The antenna system includes a ground plane, a vertical array antenna, a beam former, and multiple waveguides. The vertical array antenna includes a housing positioned above the ground plane and multiple antenna elements. Each antenna element produces an individual beam pattern. The antenna elements are attached to the housing at different distances from the ground plane such that amplitudes of the individual beam patterns of the respective antenna elements have local maxima at a common angle and frequency. The beam former has an input and multiple outputs, wherein a signal that is received at the input is provided as signals of approximately equal strength at the outputs. The waveguides are coupled between an output of the beam former and the antenna element.

According to certain embodiments, a method of designing a vertical array antenna to have at least a specified gain at a design frequency and a design beam angle is disclosed. The method includes the steps of selecting an antenna element with a suitable polarization and nominal free space element pattern, selecting a distance of a first antenna element from a ground plane such that the first lobe at the design frequency is aligned with the design beam angle, adding a $n^{th}$ element to the design, selecting a distance of the $n^{th}$ element from the ground plane such that a lobe of the $n^{th}$ element at the design frequency is aligned with the design beam angle, and calculating, after each element is added, the gain of the vertical array antenna at the design frequency and design beam angle and repeating the step of adding an element until the specified gain is achieved.

In the following description, specific embodiments are described to shown by way of illustration how the invention may be practiced. It is to be understood that other embodiments may be utilized and changes may be made without departing from the scope of the present invention.

DETAILED DESCRIPTION

There is a need for a small antenna system that provides a desired amount of gain with a minimal number of elements. An antenna of this type is particularly advantageous on small satellites in low-Earth orbit. The antenna of the present application provides at least some of these features and will have a gain approximately 3 dB higher than an antenna that does not intentionally use the ground plane.

Figure 1:
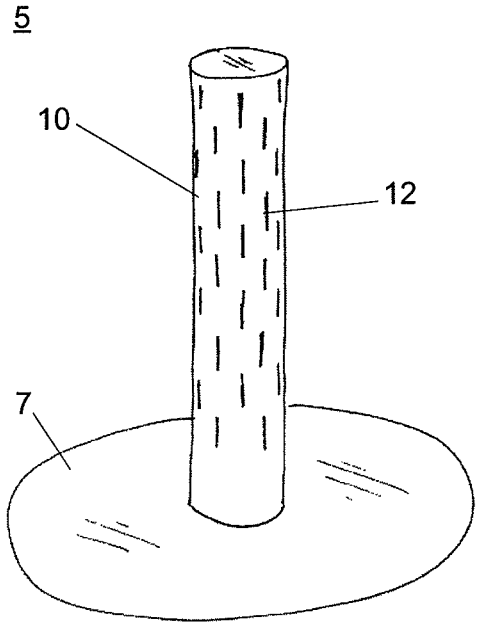
FIGURE 1 PRIOR ART
FIG. 1 illustrates a slotted waveguide antenna mounted on a flat ground plane.

FIG. 1 illustrates a slotted waveguide antenna 5 mounted on a flat ground plane 7. The antenna is a closed-end hollow tube 10 with multiple slots 12 cut through the sidewall. A signal is introduced at the base of the tube (not shown) and each of these slots serves as a radiative element. The composite antenna pattern for a slotted waveguide antenna 5 of this type can have a good gain at angles near 90 degrees from the vertical axis of the antenna and be very symmetric around the 360 degrees of the azimuth angle. The size of the slots 12 is dependent upon the frequency of the signal and the number of slots 12, and therefore the overall height, is driven by the desired gain. For the example 3 GHz system discussed in later figures, this type of antenna would be approximately 31 inches tall. While this height may be acceptable in some applications, it may be too tall in other applications such as small satellites.

Figure 2:
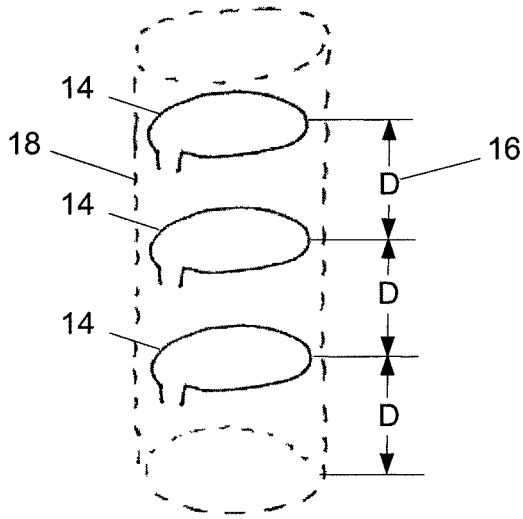
FIGURE 2 PRIOR ART
FIG. 2 illustrates a vertical array antenna utilizing loop antenna elements with a constant inter-element spacing.

FIG. 2 illustrates a vertical array antenna utilizing planar loop antenna elements 14 with a constant inter-element spacing D (label 16). A structural housing 18 that supports the antenna elements 14 is shown in phantom. Loop antenna radiate phi polarized signals and are easy to fabricate. As previously discussed, inter-element separation D (16) is chosen to be less than a wavelength of the frequency of interest, and typically a half-wavelength. For the example 3 GHz system discussed in later figures, this type of antenna would be approximately 24 inches tall. While this height may be acceptable in some applications, it may be too tall in other applications such as small satellites.

Figure 3:
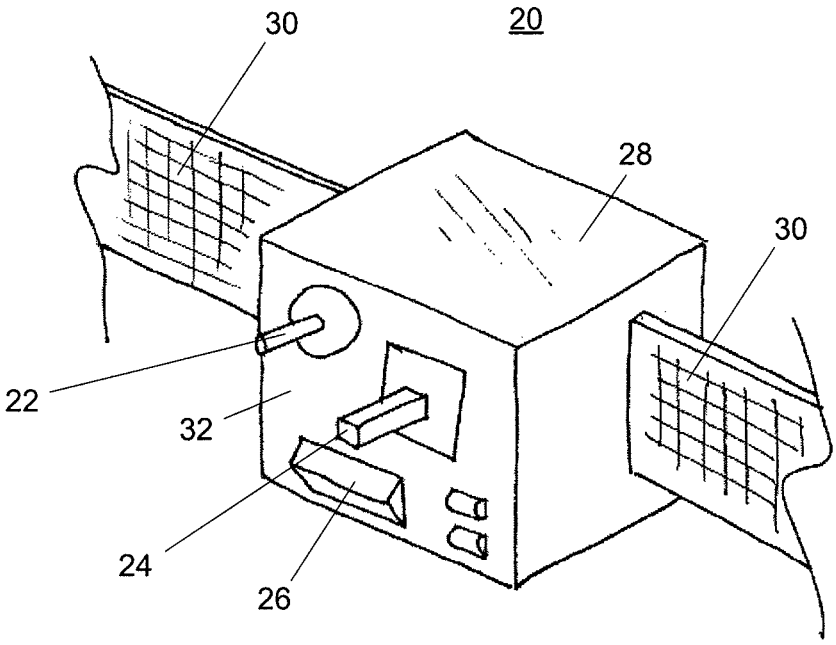
FIG. 3 shows a portion of a simplified small satellite with multiple antennas located in a common area.

FIG. 3 shows a portion of a simplified small satellite 20 with multiple antennas 22, 24, and 26 located in a common area. When multiple antennas are grouped in this manner, the resulting area is sometimes referred to as an "antenna farm." In this simplified diagram, the satellite 20 has a central body 28 having two solar panels 30 extending out on opposite sides. The side of the satellite body is a ground plane 32 on which antennas 22, 24, and 26 are mounted. It can be seen that a large antenna could take up an excessive amount of the available space and the reduced separation of antennas could create interference between the antennas.

Figure 4A:
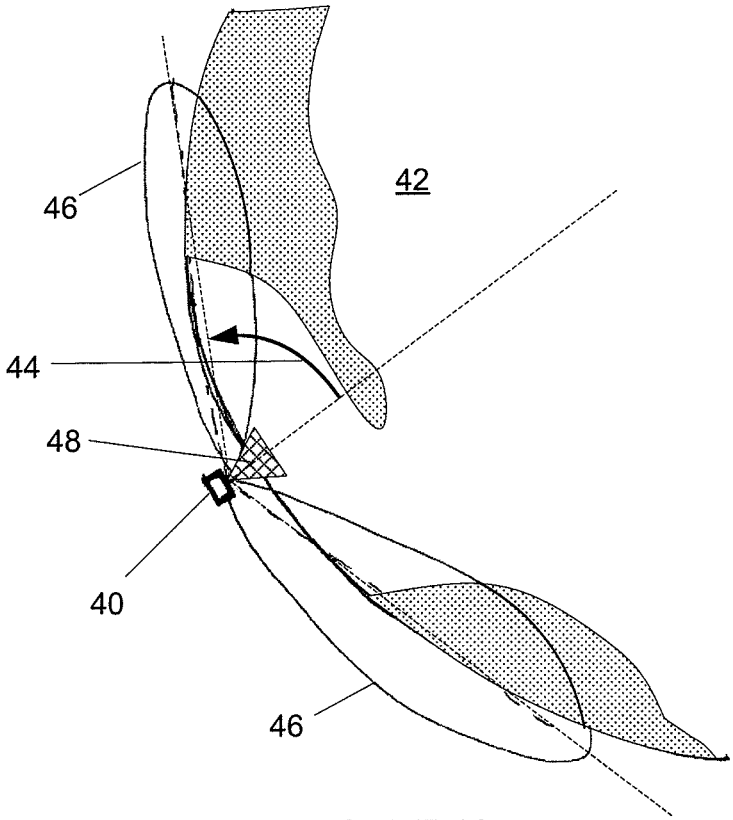
FIG. 4A illustrates how large-angle antenna patterns provide coverage for a satellite in low-Earth orbit.

FIG. 4A illustrates how large-angle antenna patterns provide coverage for a LEO satellite 40. As the diameter of the Earth 42 is approximately 12,700 kilometers (roughly 8000 miles) and low-Earth orbits start just above the atmosphere at 180 kilometers (110 miles), a common analogy is to think of a low-Earth orbit as the fuzz on a peach. From the viewpoint of satellite 40, the Earth 42 fills almost half of the sky, and the angle from the nadir to the horizon approaches 90 degrees. FIG. 4A shows how an antenna having a beam angle 44 of approximately 70 degrees creates a beam pattern 46 that covers a large portion of the visible surface of the Earth. By comparison, the area of the Earth covered by an antenna beam 48 that is aligned with the nadir axis covers only a small fraction of the visible surface of the Earth. It can be seen from this comparison that it may be a good tradeoff in the design of an antenna to accept a "null", or low-gain region, on the vertical axis of an antenna pointing along the nadir axis of the satellite in order to obtain higher gain or superior beam shape at larger angles.

Figure 4B:
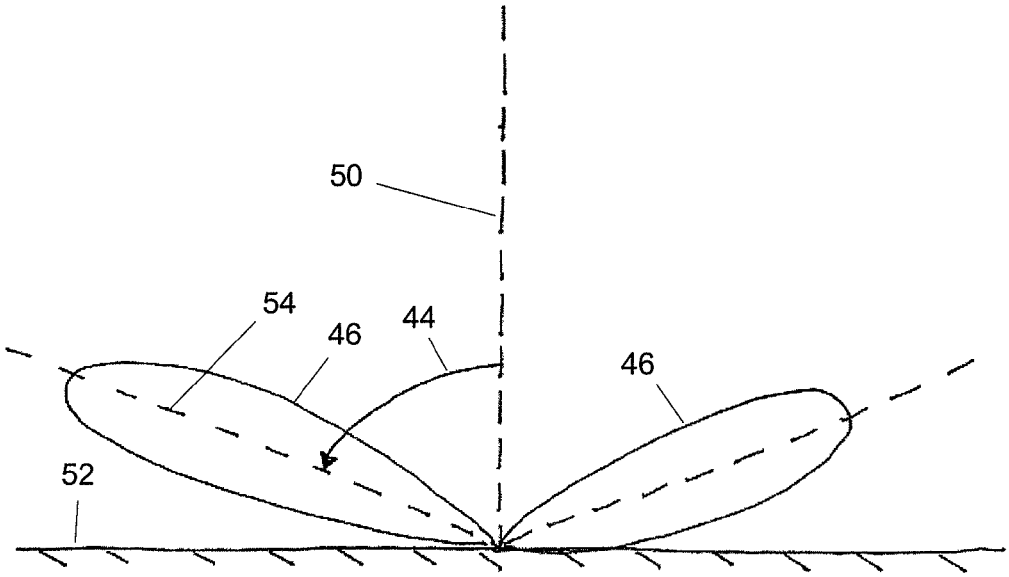
FIG. 4B shows a schematic of an off-axis antenna beam pattern according to certain aspects of the present disclosure.

FIG. 4B shows a schematic of an off-axis antenna beam 46 of the type shown for the satellite 40 of FIG. 4A, according to certain aspects of the present disclosure. The antenna system has a vertical axis 50 that is perpendicular to the ground plane 52. As the antenna field is of interest at distances far from the antenna, referred to as the "far field", beam 46 is considered to radiate from the point where the vertical axis 50 intersects the ground plane 52. The angle 44 is the beam angle of this antenna and defines the central axis 54 of the beam 46. In this view, there are symmetric parts of beam 46 on each side of the axis as beam 46 is symmetric in azimuth, i.e. the rotational angle about the axis 50. Beam 46 has a null on axis, as discussed above, which is advantageous in that it reduces the cross-coupling of antenna elements 56.

Figure 5:
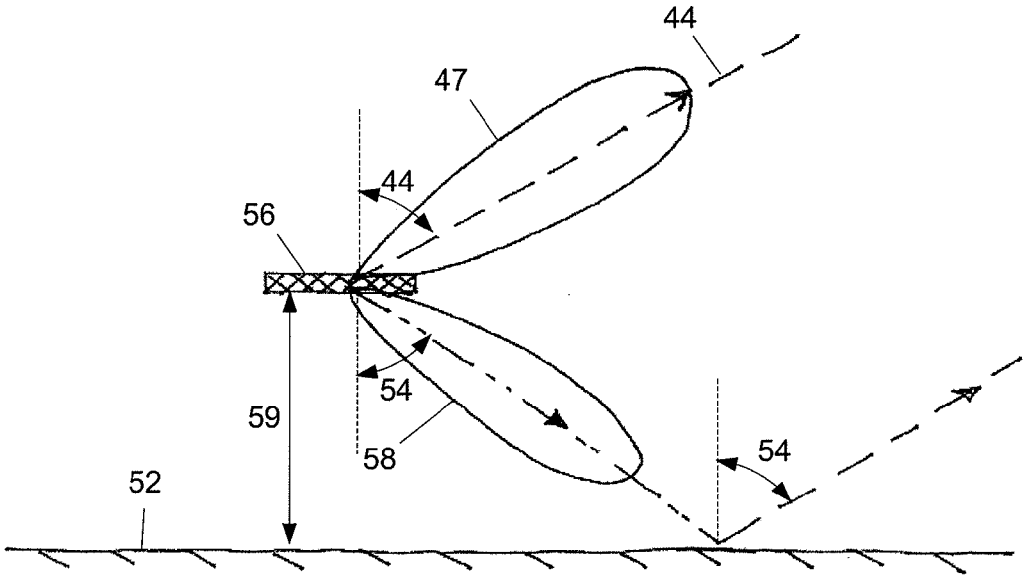
FIG. 5 shows how a back lobe is reflected by the ground plane to add to the main beam according to certain aspects of the present disclosure.

FIG. 5 shows how a back lobe 58 of the field radiating from an antenna element 56 is reflected by the ground plane 52 to add to the direct main lobe 47 according to certain aspects of the present disclosure. By selection of the distance 59 of the element 56 above ground plane 52, the back lobe 58 is emitted at an angle 54 that is equal to the angle 44 of the main lobe 47. As the back lobe 58 will reflect in a specular manner from the ground plane 52, the reflected back lobe 58 is now traveling parallel to the path of main lobe 47. In the far field, lobes 47 and 58 will add together to form a beam 46 that has a maximum at the desired angle 44 as shown in FIGS. 4A & 4B.

Figure 6A:
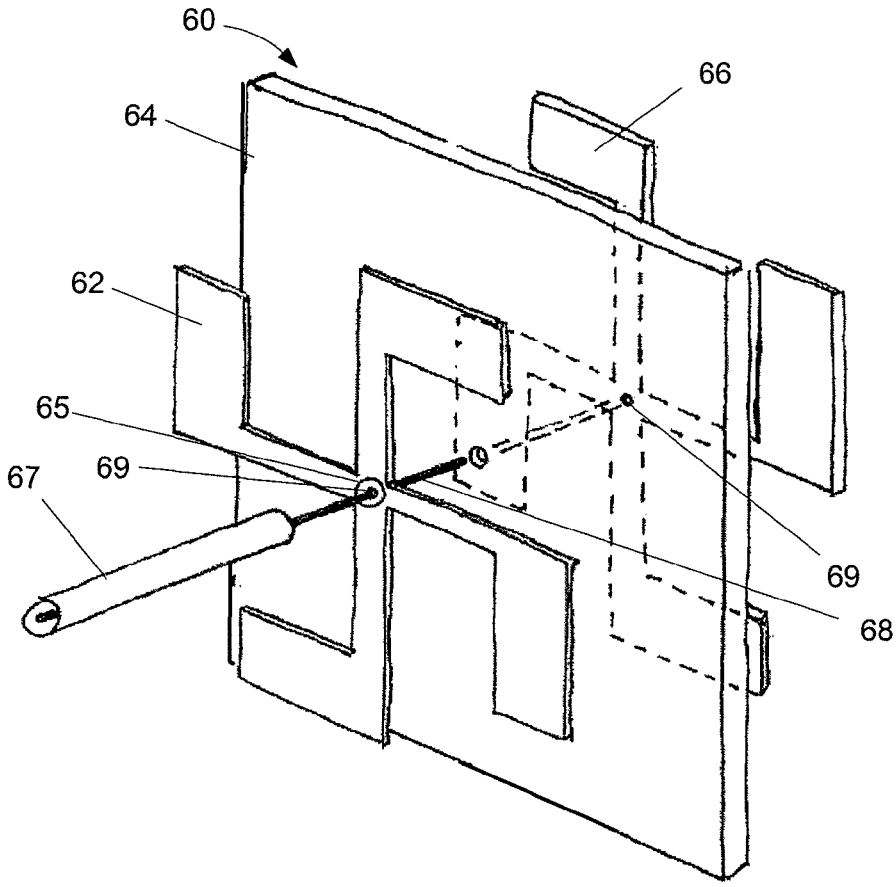
FIGS. 6A & 6B show examples of Alford Loop antenna elements according to certain aspects of the present disclosure.
Figure 6B:
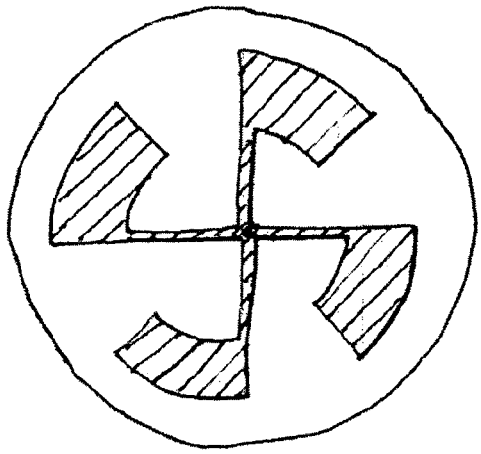

FIGS. 6A & 6B show examples of Alford Loop antenna elements according to certain aspects of the present disclosure. Alford Loop antennas are balanced loop antennas invented by Andrew Alford. They radiate a horizontally polarized field. This particular example of an Alford Loop is four dipoles arrayed in a square and combined with four transmission lines. FIG. 6A shows a separated view of an Alford Loop antenna element 60 having a central support element 64 that may be a low-loss/low-dielectric material such as Rogers 6002 or other material that is dimensionally stable and suitable for use in space. Conductive elements 62 and 66 of a "pin wheel" configuration are attached to the faces of support element 64 and may be formed of any conductive material such as copper or aluminum, and formed in a plurality of manners including etching of cladding on the central support element 64 or adhesively attached foil. A waveguide such as co-axial cable 67 is connected to the two elements 62 and 66, with the outer conductor connected to the element 62 on the nearside and the inner conductor 68 passing through an insulated hole 69 that is continuous through the nearside conductive element 62, the center support element 64, and the farside element 66, where inner conductor 68 connects to element 66. There is a gap 65 around hole 69 in the nearside element 62 and the outer conductor of coaxial cable 67 connects to element 62 outside gap 65. This specific Alford Loop antenna is four dipoles added together with transmission lines so that they have equal amplitude and phase. Arrangements other than 4 elements can be implemented. FIG. 6B is an example of an Alford Loop antenna having a circular profile, where the pattern on the backside (not shown) is also reversed similar to that of FIG. 6A.

In certain applications, a vertical array antenna may use other types of antenna elements with other polarizations such as higher-mode spiral antennas with circular polarization, vertical dipole antennas with theta polarization, vertical slot antennas with phi polarization, loop antennas with phi polarization, annular rings with phi polarization, and patch arrays with circular, theta or phi polarization. The choice of polarization in selection of an antenna element is driven by the higher-level communication system design because the ground antenna and the spacecraft antenna must use a common polarization. This system design choice of polarization flows down as a design requirement to the antenna. Another aspect of antenna element selection, for a vertical array antenna as disclosed herein, is that the nominal free space element pattern (i.e. the pattern of lobes of the field created by the antenna element in free space) have a null on axis. A null on axis reduces the coupling between antenna elements. "Theta" and "phi" refer to a spherical coordinate system wherein theta is analogous to geographic latitude and phi is analogous to geographic longitude. Theta angles are also referred to as elevation and phi angles are also referred to as azimuth. Theta angles are specified herein as the angle from an axis perpendicular to a ground plane.

Figure 7:
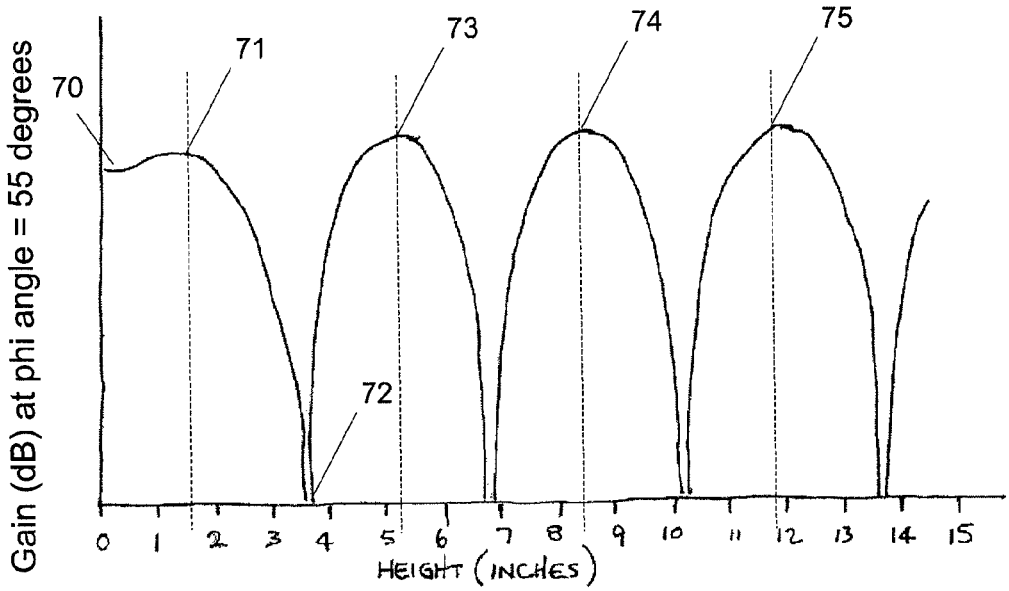
FIG. 7 illustrates an example of the gain of an antenna element at theta angle of 55 degrees from vertical at a frequency of 3 GHz over a range of height above a ground plane according to certain aspects of the present disclosure.

FIG. 7 illustrates an example of the amplitude of the gain 70 at a theta angle of 55 degrees (angle 44 of FIG. 4B) at a frequency of 3 GHz of an antenna element over a range of height above a ground plane according to certain aspects of the present disclosure. As the height of the antenna element 56 above ground plane 52 is increased, the amplitude first increases to a peak 71 above the value at zero height as, with reference to FIG. 5, the back lobe 58 adds to the primary field 47. The amplitude then drops to nearly zero at point 72 as the fields 47 and 58 interfere, and then varies between a local maximum and minimum as the height is increased. To achieve the most efficient antenna, i.e. produce the largest amplitude field at the design angle, it is desirable to place antenna element 56 at any of the heights associated with a local maxima such as points 73, 74, and 75 of gain 70.

Figure 8:
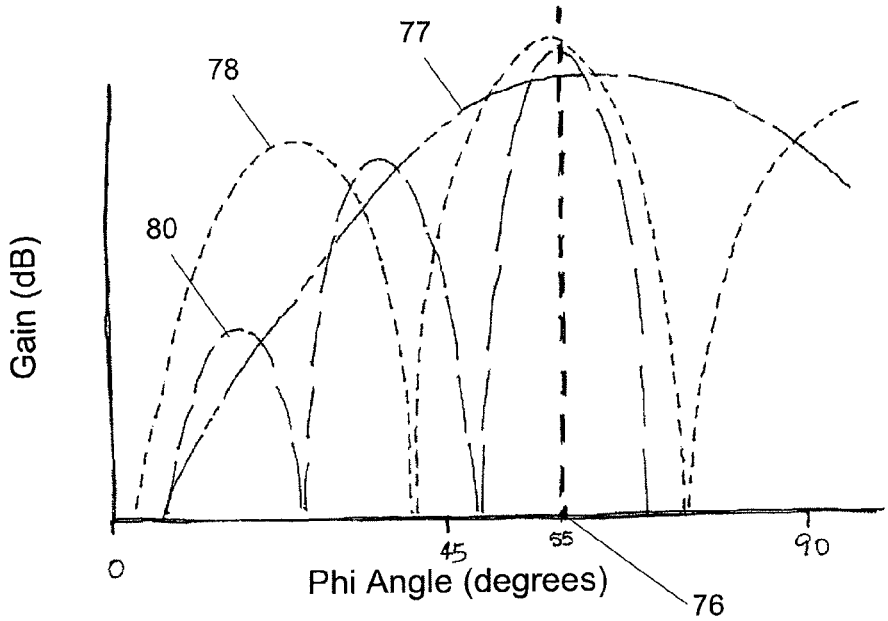
FIG. 8 illustrates an overlay of the gains of multiple antenna elements according to certain aspects of the present disclosure.

FIG. 8 illustrates an overlay of the gains of multiple antenna elements according to certain aspects of the present disclosure. In this plot, the gain is plotted against angle 44. In this example, multiple elements have been selected for an antenna designed for a beam angle 44 of 55 degrees. This design angle is shown as dashed line 76. Line 77 is the gain of a first element 56 at a height of 1.6 inches, again referring to FIG. 5, selected from a plot similar to that of FIG. 7 such that the beam pattern of the element 56 has a first peak 71 at 55 degrees. Line 78 is the plot of the gain of a second element 56 at a height of 5.2 inches where the second lobe of its beam pattern, indicated by point 73 of FIG. 7, has a local maximum at 55 degrees. It can be seen that lobes of the field from this second element 56 exist at angles above and below 55 degrees. In a similar manner, line 80 shows the gain of the field from a third element 56 at a height of 8.4 inches where the peak 74 of the third lobe of its beam pattern of FIG. 7 has a local maximum at 55 degrees in FIG. 8. Again, there are additional lobes from the third element 56 at other angles. It can be seen conceptually that, in this example, the lobes of the fields from the three elements that are aligned at 55 degrees will add together to produce a much stronger field 46 at this design angle than will be produced over the remaining range of angles where the fields are not aligned.

Figure 9:
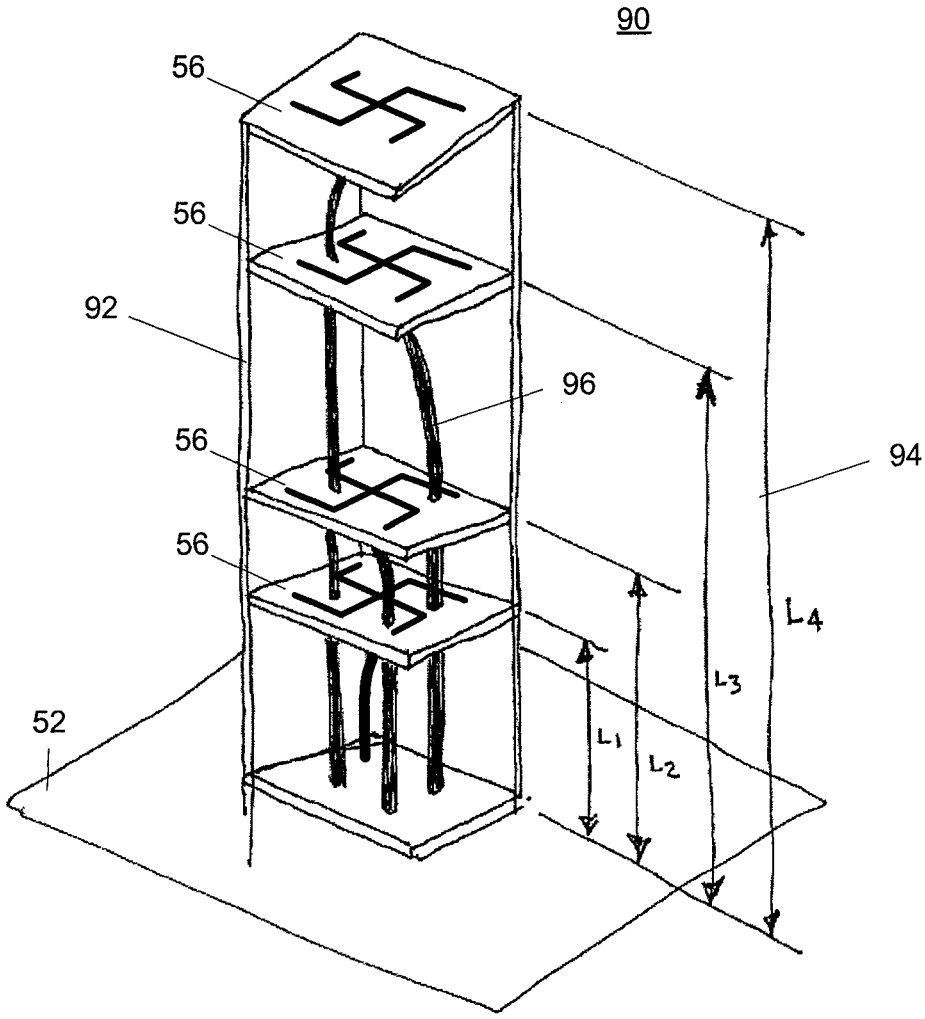
FIG. 9 illustrates an example construction of a vertical array antenna designed according to certain aspects of the present disclosure.

FIG. 9 illustrates an example construction of a vertical array antenna 90 designed according to certain aspects of the present disclosure. There is a structural support 92 comprising a material having sufficient mechanical strength to support the four antenna elements 56 above ground plane 52 and also having a minimal effect on the beam patterns and gain amplitudes of the antenna elements 56. Signals are provided to each antenna element 56 in this example via coaxial cables 96. The cables to the higher elements 56 pass through holes in the open space of the Alford Loop on the lower antenna elements 56 and connect to feedthrough connectors (not shown) at the base. The antenna elements 56 are mounted at heights 94, designed L1 through L4. While this example shows 4 antenna elements 56, in other configurations for other applications, the vertical array antenna 90 may have more or fewer antenna elements 56.

Figure 10:
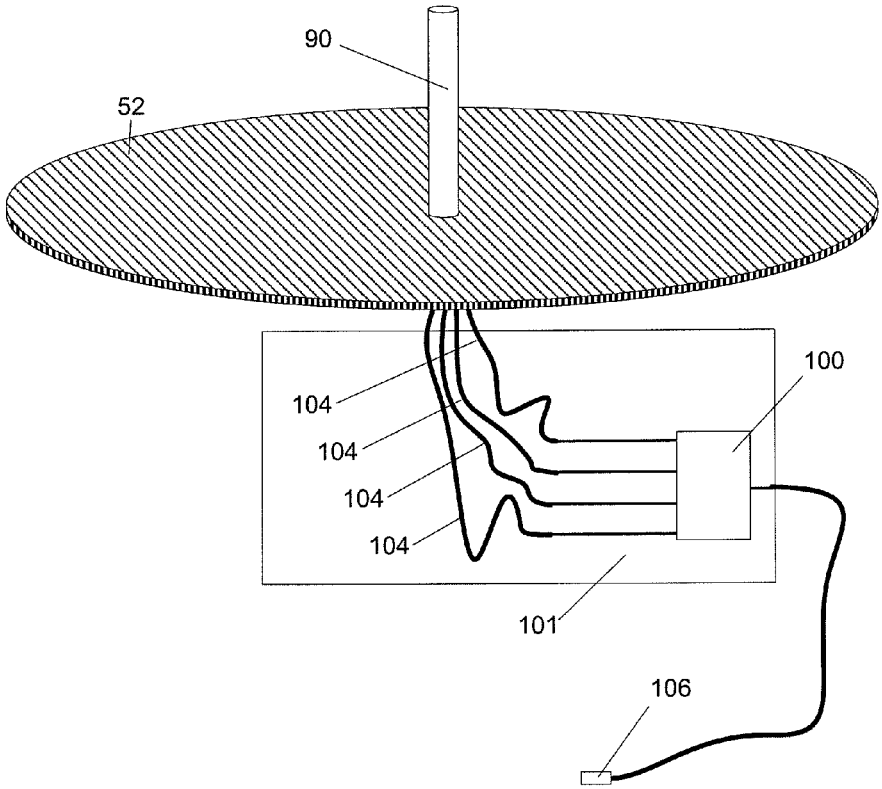
FIG. 10 illustrates an example construction of an antenna system designed according to certain aspects of the present disclosure.

FIG. 10 illustrates an example construction of an antenna system designed according to certain aspects of the present disclosure. This example is for a system operating at 3 GHz with a gain of 10 decibels (dBil) at 55 degrees. Ground plane 52 is approximately 1.2 meters (48 inches) in diameter with the four-element vertical array antenna 90 of FIG. 9 mounted in the center. The power is distributed using a power combiner 100. Phasing can be accomplished by time delay or phase shifters 104 to optimize gain at the design angle and frequency. Signals are provided to the antenna system at input connector 106.

Figure 11:
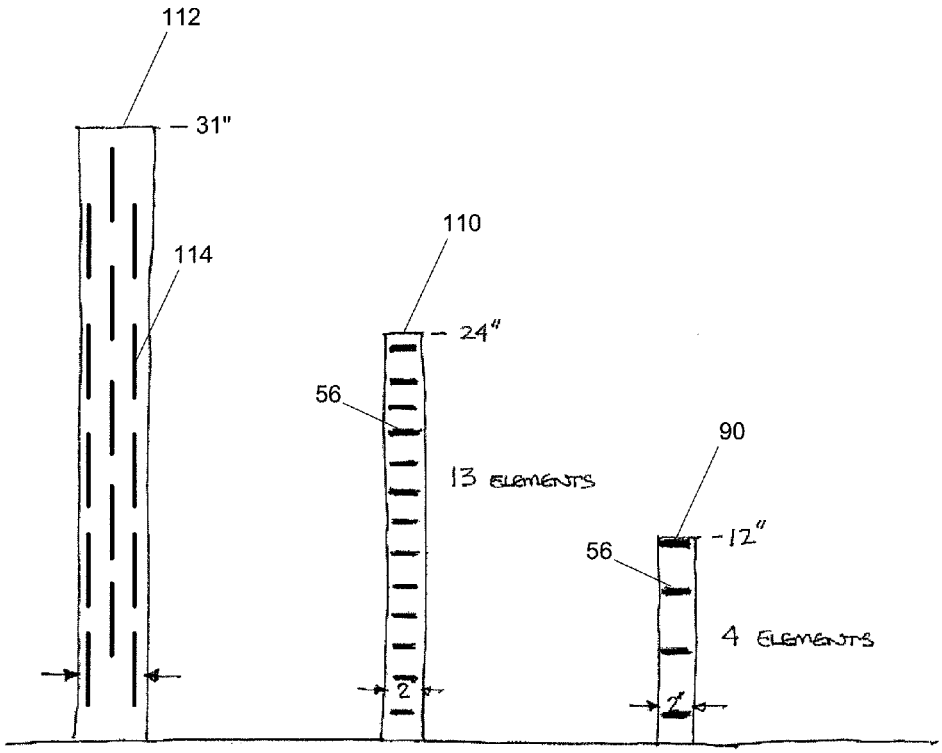
FIG. 11 illustrates a comparison of a vertical array antenna designed according to certain aspects of the present disclosure with two antenna designed using other methodologies.

FIG. 11 illustrates a comparison of a vertical array antenna 90 designed according to certain aspects of the present disclosure with two antennas designed using other methodologies. All of the antennas are designed to a common set of objectives including a frequency of 3 GHz, a gain amplitude of 10 dB, and a symmetric beam having an angle of 55 degrees. Antenna 112 is a slotted waveguide array that is approximately 0.8 meters (31 inches) tall and approximately 100 millimeters (4 inches) in diameter. While this type of antenna is simple and proven, this height is too tall for many applications. Antenna 110 is a vertical array of Alford Loop antennas that are approximately 45 millimeters (1.75 inches) square, similar to that shown in FIG. 6A. Antenna elements were equally spaced at a half wavelength, which for a 3 GHz signal is approximately 50 millimeters (2 inches). Antenna elements were added until the gain amplitude reached the design objective of 10 dB. This design required 13 elements resulting in a height of approximately 0.6 meters (24 inches), which is shorter than that of slotted waveguide 112 but still too tall for some applications. Antenna 90, designed in accordance with the disclosure herein, includes 4 of the same Alford Loop antenna elements of antenna 110 at individual heights as listed in Table 1 below, with the total height of antenna 90 being just under 0.3 meters (12 inches). Designing the antenna to use the ground plane to reflect a back lobe such that the back lobe adds to the main signal effectively doubles the height of the antenna, i.e the gain is doubled (+3 dB).

TABLE 1

| Dimension Designator (from FIG. 9) | value (inches) |
|---|---|
| L4 | 11.84 |
| L3 | 8.46 |
| L2 | 5.47 |
| L1 | 1.97 |

The reduced number of elements of antenna 90, compared to antenna 110, reduces cost both directly due to fewer parts (4 sets of antenna elements and coax cables compared to 13 sets) and by reducing the strength and complexity of the supporting structure to run 13 coax lines while carrying the structural loads of the taller antenna. A shorter antenna of this type is also more efficient, as the losses in the cables are reduced by the shorter cable lengths. These losses are small but important in systems such as small spacecraft where every decibel of loss is important.

Figure 12:
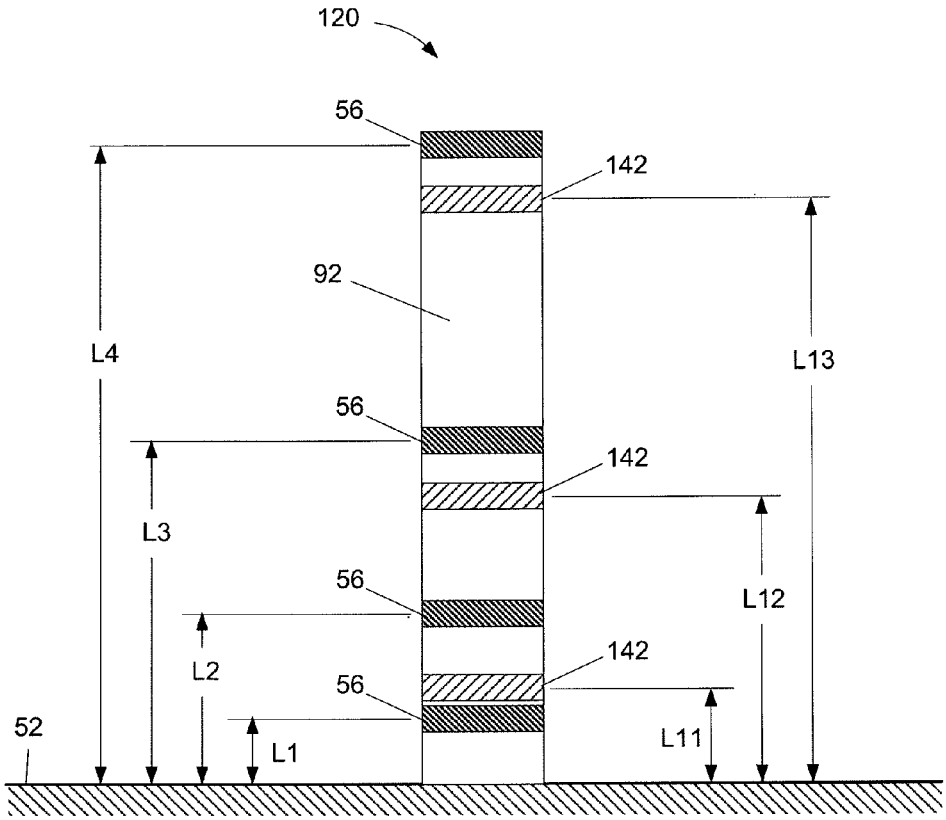
FIG. 12 illustrates the construction of an antenna system wherein the vertical array antenna has two sets of antenna elements according to certain aspects of the present disclosure.
Figure 13:
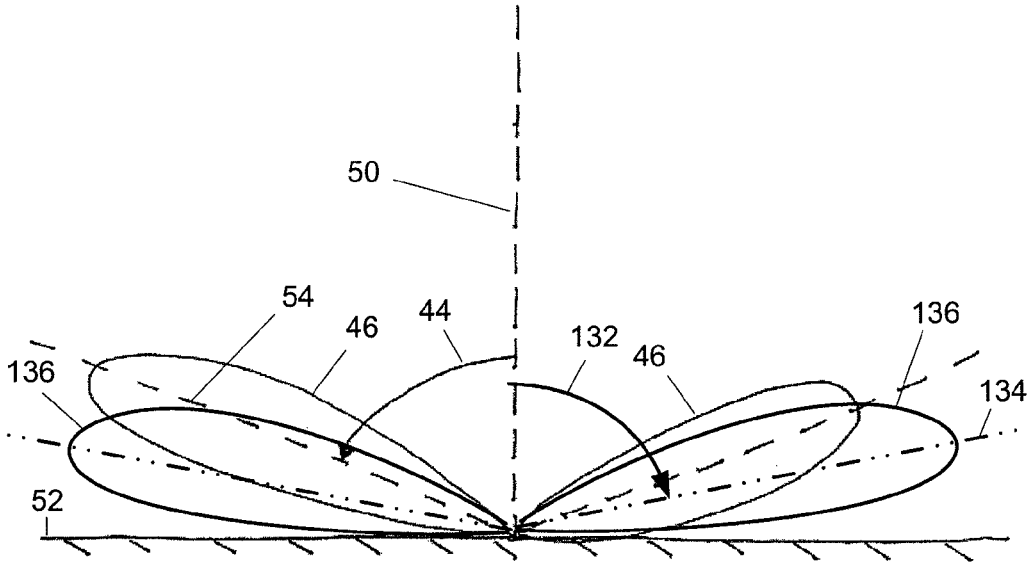
FIGS. 13 & 14 illustrate the beam patterns of antenna systems wherein the vertical array antenna has two sets of antenna elements according to certain aspects of the present disclosure.

FIG. 12 illustrates the construction of an antenna system 120 wherein the vertical array antenna has two sets of antenna elements according to certain aspects of the present disclosure. The housing 92 and the set of antenna elements 56 are repeated from FIG. 9 and, together with the ground plane 52, form a first beam 46 as shown in FIG. 4B and repeated as part of FIG. 13. The second set of antenna elements 142 has, in this example, three antenna elements that are also attached to housing 92 at heights L11, L12, and L13 from the ground plane 52. The second set of antenna elements 142, together with the ground plane 52, form a second beam 136 as shown in FIG. 13. Antenna elements 142 may be the same as antenna elements 56, the same type of antenna designed for a different frequency, or a different type of antenna element. While this example shows four antenna elements 56 and three antenna elements 142, each set may have other quantities of antenna elements in other configurations according to the performance requirements of the antenna system. In certain configurations, an antenna element may be part of both sets of antenna elements 56 and 142. The antenna elements 142 may be fed signals from the same power combiner 100, referring to the example antenna system of FIG. 10, or may have a separate beam former and set of coaxial cables. Additional sets of antenna elements (not shown) may be added to form additional beams.

Figure 14:
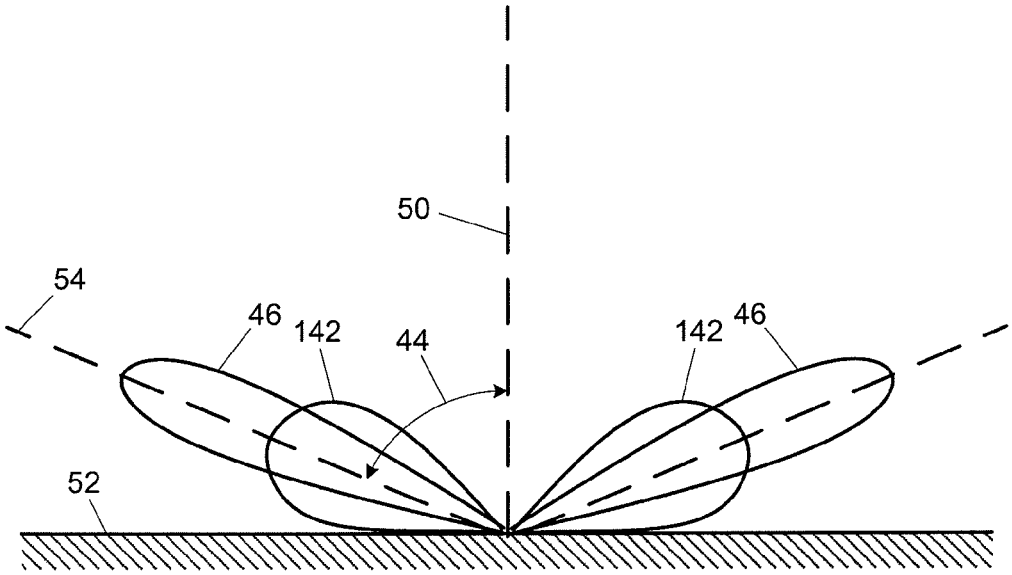

FIGS. 13 & 14 illustrate the beam patterns of antenna systems wherein the vertical array antenna has two sets of antenna elements according to certain aspects of the present disclosure.

FIG. 13 is an example of the beams produced by an antenna system of the type shown in FIG. 12. Antenna elements 56 form beam 46 at an angle 44 while elements 142 form beam 136 at angle 132. For example, angle 44 may be approximately 55 degrees while angle 132 may be approximately 70 degrees. If the antenna elements 142 and 56 are the same and operating at the same frequency, then two separate beams are created. FIG. 14 is an example where the antenna elements 142 are different from the antenna elements 56 and operating at a different frequency and located at the appropriate heights to form a beam 142 at an angle 44 common to beam 46. Beams 142 and 46 may have different gains, represented by the different sizes of the beams 142 and 46 in the example of FIG. 14. Other combinations of frequency and beam angle are possible according to the types and design of antenna elements and the angle of beam 142 may be different from that of beam 46.

In summary, the present application discloses a vertical array antenna that is shorter than an equivalent slotted waveguide antenna of the same frequency, gain, and beam angle. The antenna of the present application is shorter, more efficient, and less expensive to fabricate than a vertical array antenna designed according to existing design guidelines. Aligning the local maxima of each antenna element to a common angle maximizes the amplitude of the antenna gain on this axis for a given number of elements. Selecting the heights of the antenna elements to productively incorporate the reflected back lobe with the main lobe of the beam approximately doubles the amplitude contribution of each antenna element and effectively doubles the height of the antenna, i.e. doubles the gain.

The previous description is provided to enable any person skilled in the art to practice the various aspects described herein. While the foregoing has described what are considered to be the best mode and/or other examples, it is understood that various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the terms "some" and "multiple" refer to one or more. Pronouns in the masculine (e.g., his) include the feminine and neuter gender (e.g., her and its) and vice versa. Headings and subheadings, if any, are used for convenience only and do not limit the invention.

It is understood that the specific configurations disclosed are illustrations of exemplary designs. Based upon design preferences, it is understood that the specific components may be rearranged. In some embodiments, some components may be omitted, relocated, replaced with equivalent items, or combined with other components without departing from the scope of the present invention. In some embodiments, some functions presented as occurring in one component may occur in a different component or be implemented in a different manner. The accompanying claims present elements of the various systems in a sample configuration, and are not meant to be limited to the specific order or hierarchy presented.

It is understood that the specific order or hierarchy of steps in the processes disclosed is an illustration of exemplary approaches. Based upon design preferences, it is understood that the specific order or hierarchy of steps in the processes may be rearranged. In some embodiments, some steps may be performed simultaneously. In some embodiments, steps may be omitted. The accompanying method claims present elements of the various steps in a sample order, and are not meant to be limited to the specific order or hierarchy presented.

The designs and methodologies disclosed herein are applicable over a wide range of frequencies in the range of 300 MHz to 300 GHz. While the example is given at 3 GHz, as the benefits are greater at lower frequencies, the designs and methodologies are equally applicable to other bands used in communication such as the C (4 to 8 GHz), X (8 to 12 GHz), or Ka (26.5 to 40 GHz) bands of the microwave spectrum.

Terms such as "top," "bottom," "front," "rear", "above", and "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A vertical array antenna comprising:

a housing having an axis and configured to be positioned adjacent to a ground plane that extends beyond the housing with the axis perpendicular to the ground plane; and a plurality of antenna elements, each antenna element producing an individual beam pattern, the plurality of antenna elements being attached to the housing along the axis at different respective distances from the location of the ground plane such that amplitudes of the individual beam patterns of the respective antenna elements have local maxima at a common first angle of less than 90° with respect to the ground plane and a common first frequency when the housing is positioned above the ground plane.

2. The vertical array antenna of claim 1, wherein each antenna element creates a back lobe that reflects off the ground plane and adds constructively in phase to the beam pattern at the common angle and frequency in the far field.

3. The vertical array antenna of claim 1, wherein the antenna elements radiate a field that is approximately symmetric in azimuth.

4. The vertical array antenna of claim 3, wherein the antenna elements radiate a field having a null on the vertical axis.

5. The vertical array antenna of claim 1, wherein the antenna elements are selected from the group consisting of Alford Loop antennas, spiral antennas, vertical dipole antennas, vertical slot antennas, loop antennas, annular rings antennas, and patch arrays.

6. The vertical array antenna of claim 1, wherein the common first frequency is 3 GHz, the common first angle is 55 degrees, the number of antenna elements is at least four, and the maximum distance of the fourth antenna element from the location of the ground plane is 12 inches.

7. The vertical array antenna of claim 6, wherein the antenna elements are pinwheel Alford Loops.

8. The vertical array antenna of claim 7, wherein the distances of the antenna elements from the ground place are approximately 1.8, 5.1, 8.6, and 12.0 inches.

9. An antenna system comprising:

a ground plane;

a vertical array antenna comprising:

a housing positioned adjacent to the ground plane; and a first plurality of antenna elements, each of the first plurality of antenna elements producing an individual beam pattern, the first plurality of antenna elements being attached to the housing along an axis perpendicular to the ground plane and at different respective distances from the ground plane such that amplitudes of the individual beam patterns of the respective first plurality of antenna elements have local maxima at a common first angle and first frequency;

a first beam former having an input and a plurality of outputs, wherein a signal that is received at the input is provided as signals of approximately equal strength at the outputs; and a first plurality of waveguides, each waveguide coupled between an output of the first beam former and one of the first plurality of antenna elements.

10. The antenna system of claim 9, wherein each antenna element creates a back lobe that reflects off the ground plane and adds constructively in phase to the beam pattern at the common angle and frequency in the far field.

11. The antenna system of claim 9, wherein the housing is positioned at selected distance from the ground plane.

12. The antenna system of claim 11, wherein the housing is attached to the ground plane.

13. The antenna system of claim 9, wherein the antenna elements radiate a field that is approximately symmetric in azimuth.

14. The antenna system of claim 9, wherein the antenna elements radiate a field having a null on the vertical axis.

15. The antenna system of claim 9, wherein the vertical array antenna further comprises a second plurality of antenna elements that are attached to the housing along an axis perpendicular to the ground plan at different respective distances from the ground plane such that amplitudes of the individual beam patterns of the respective second plurality of antenna elements have local maxima at a common second angle at a common second frequency.

16. The antenna system of claim 15, wherein the second angle is different from the first angle.

17. The antenna system of claim 15, further comprising:

a second beam former having an input and a plurality of outputs; and a second plurality of waveguides, each waveguide coupled between an output of the second beam former and one of the second plurality of antenna elements;

wherein the second beam former, the second plurality of waveguides, and the second plurality of antenna elements are all configured to operate at the second frequency, wherein the second frequency is different from the first frequency.

18. The antenna system of claim 17, wherein the second angle is approximately the same as the first angle.

* * * * *